US010988915B2

(12) United States Patent
Kang

(10) Patent No.: US 10,988,915 B2
(45) Date of Patent: Apr. 27, 2021

(54) HYDRAULIC SYSTEM OF CONSTRUCTION MACHINERY

(71) Applicant: DOOSAN INFRACORE CO., LTD., Incheon (KR)

(72) Inventor: Byung Il Kang, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/604,508

(22) PCT Filed: Apr. 10, 2018

(86) PCT No.: PCT/KR2018/004193
§ 371 (c)(1),
(2) Date: Oct. 10, 2019

(87) PCT Pub. No.: WO2018/190615
PCT Pub. Date: Oct. 18, 2018

(65) Prior Publication Data

US 2020/0123737 A1 Apr. 23, 2020

(30) Foreign Application Priority Data

Apr. 10, 2017 (KR) ..... 10-2017-0046226

(51) Int. Cl.
*E02F 9/22* (2006.01)
*F15B 11/024* (2006.01)
(Continued)

(52) U.S. Cl.
CPC ..... *E02F 9/2217* (2013.01); *E02F 9/2221* (2013.01); *E02F 9/2267* (2013.01);
(Continued)

(58) Field of Classification Search
CPC ..... F15B 21/14; F15B 2211/88; F15B 2211/761; E02F 9/2217
See application file for complete search history.

(56) References Cited

U.S. PATENT DOCUMENTS 7,637,103 B2 12/2009 Karl et al.
9,016,054 B2 4/2015 Honsbein
(Continued)

FOREIGN PATENT DOCUMENTS

EP 3093398 A1 11/2016
JP 2009275769 A * 11/2009 ..... E02F 9/2217
(Continued)

OTHER PUBLICATIONS

JP 2009275769 A machine translation from espacenet (Year: 2009).*
(Continued)

*Primary Examiner* — Michael Leslie
*Assistant Examiner* — Michael Quandt
(74) *Attorney, Agent, or Firm* — Hauptman Ham, LLP

(57) ABSTRACT

A hydraulic system of construction machinery includes: a boom cylinder divided; a first boom hydraulic line serving to supply a hydraulic oil to the boom cylinder during an ascending operation of a boom; a second boom hydraulic line serving to supply the hydraulic oil to the boom cylinder during a descending operation of the boom; a regeneration line serving so that the hydraulic oil discharged from the head side of the boom cylinder flows during the descending operation of the boom; a circulation line connected to the second boom hydraulic line; an accumulator connected to the regeneration line and serving to accumulate the hydraulic oil discharged from the boom cylinder; a boom regeneration valve including a first regeneration spool and a second regeneration spool; and a control unit serving to adjust opening areas of the first regeneration spool and the
(Continued)

second regeneration spool during the descending operation of the boom.

10 Claims, 4 Drawing Sheets

(51) Int. Cl.
*F15B 21/14* (2006.01)
*F15B 1/02* (2006.01)

(52) U.S. Cl.
CPC ..... *F15B 1/02* (2013.01); *F15B 11/024* (2013.01); *F15B 21/14* (2013.01); *E02F 9/2296* (2013.01); *F15B 2211/20523* (2013.01); *F15B 2211/20546* (2013.01); *F15B 2211/212* (2013.01); *F15B 2211/3058* (2013.01); *F15B 2211/6336* (2013.01); *F15B 2211/75* (2013.01); *F15B 2211/761* (2013.01); *F15B 2211/88* (2013.01)

(56) References Cited

U.S. PATENT DOCUMENTS 9,279,236 B2 * 3/2016 Zhang ..... E02F 9/2217
9,447,562 B2 9/2016 Takaura et al.
10,174,484 B2 1/2019 Joo
2009/0000290 A1 1/2009 Brinkman
2013/0133966 A1 * 5/2013 Jiang ..... F15B 1/024 180/165
2013/0318955 A1 12/2013 Zhang et al.

FOREIGN PATENT DOCUMENTS

KR 10-0953809 B1 4/2010
KR 10-1217755 B1 1/2013
KR 10-2016-0101926 A 8/2016
KR 10-1650692 B1 8/2016
KR 10-1658326 B1 9/2016
WO 2017094986 A1 6/2017

OTHER PUBLICATIONS

International Search Report dated Aug. 20, 2018, in connection with counterpart International Patent Application No. PCT/KR2018/004193, citing the above references.
Extended European Search Report dated Apr. 9, 2020 in connection with the counterpart European Patent Application No. EP18784964.1.

* cited by examiner

HYDRAULIC SYSTEM OF CONSTRUCTION MACHINERY

CROSS REFERENCE TO RELATED APPLICATION

This present application is a national stage filing under 35 U.S.C § 371 of PCT application number PCT/KR2018/0041.93 filed on Apr. 10, 2018 which is based upon and claims the benefit of priority to Korean Patent Application No. 10-2017-0046226 filed on Apr. 10, 2017 in the Korean Intellectual Property Office. The disclosures of the above-listed applications are hereby incorporated by reference herein in their entirety.

TECHNICAL FIELD

The present disclosure relates to a hydraulic system of construction machinery, and more particularly, to a hydraulic system of construction machinery in which a potential energy of a boom is regenerated when the boom descends, thereby improving fuel efficiency.

DISCUSSION OF RELATED ART

A construction machinery generally refers to all machineries used in civil engineering and building construction. In general, a construction machinery includes an engine and a hydraulic pump which operates on the power of the engine. Such a construction machine travels on the power generated by the engine and the hydraulic pump or drives work devices.

For example, one type of the construction machineries is an excavator which performs excavation works for digging the ground, loading works for transporting soil, shredding works for dismantling buildings, clean-up works for organizing the ground, in the civil engineering and construction sites. Such an excavator includes a travel body which serves to transport devices, an upper turning body mounted on the travel body and rotated 360 degrees, and a work device.

In addition, such an excavator includes a travel motor used for travelling, a swing motor used for swinging the upper turning body and for driving devices such as a boom cylinder, an arm cylinder, a bucket cylinder, and an option cylinder used in the work device. These driving devices are driven by a working fluid discharged from a variable displacement hydraulic pump which is driven by an engine or an electric motor.

The excavator further includes an operation device, including, for example, a joystick, an operation lever, and a pedal, for controlling the various driving devices described above.

In recent years, energy regeneration systems which regenerate the potential energy of the work device and utilize the regenerated energy to assist operation of various driving devices have been applied to construction machineries.

In a case where a work device such as a boom moves up and down by a boom cylinder, when lowering the raised boom, the hydraulic oil on a head side of the boom cylinder is discharged from the boom cylinder at high pressure due to the potential energy of the boom. As the high-pressure hydraulic oil returns to the storage tank or is converted into thermal energy to be dissipated, the potential energy of the boom becomes extinct.

Thus, the energy regeneration system may accumulate the high-pressure hydraulic oil in an accumulator to operate a regeneration motor with the accumulated hydraulic oil, thereby capable of improving fuel efficiency of an engine for driving hydraulic pumps.

However, the accumulator causes fluctuation in the pressure of the hydraulic oil discharged from the head side of the boom cylinder, and this fluctuation in pressure makes it difficult to control the speed of the boom as the operator intends. That is, the conventional energy regeneration system has a problem in that it cannot cope with changes in the boom descending speed which changes due to the change in the pressure of the accumulator regardless of the operator's intention.

Specifically, for example, in a case where the operator operates the joystick and lowers the boom, even if the operation of the joystick is kept constant so that the boom descends at a constant speed, the pressure fluctuates due to the hydraulic oil accumulated in the accumulator, which may result in a decrease in the descending speed of the boom contrary to the intention of the operator.

SUMMARY

Embodiments of the present invention provides a hydraulic system of construction machinery capable of regenerating a potential energy of a boom to control the speed of the boom to be constant as the operator intends, while improving the fuel efficiency.

Technical Solution to the Problem

According to an embodiment, a hydraulic system of construction machinery includes: a boom cylinder divided into a head side and a rod side; a first boom hydraulic line connected to the head side of the boom cylinder and serving to supply a hydraulic oil to the boom cylinder during an ascending operation of a boom; a second boom hydraulic line connected to the rod side of the boom cylinder and serving to supply the hydraulic oil to the boom cylinder during a descending operation of the boom; a regeneration line branching from the first boom hydraulic line and serving so that the hydraulic oil discharged from the head side of the boom cylinder flows during the descending operation of the boom; a circulation line branching from the regeneration line and connected to the second boom hydraulic line; an accumulator connected to the regeneration line and serving to accumulate the hydraulic oil discharged from the boom cylinder; a boom regeneration valve including a first regeneration spool provided at the regeneration line and a second regeneration spool provided at the circulation line; and a control unit serving to close the boom regeneration valve during the ascending operation of the boom and to adjust opening areas of the first regeneration spool and the second regeneration spool by estimating a speed of the cylinder during the descending operation of the boom.

The hydraulic system may further include a pressure sensor provided at opposite ends of the second regeneration spool, and the control unit may estimate the speed of the boom cylinder by calculating a flow rate of the hydraulic oil passing through the second regeneration spool based on a pressure difference between opposite ends of the second regeneration spool measured by the pressure sensor and based on the opening area of the second regeneration spool, and increase the opening area of the first regeneration spool or the second regeneration spool when the estimated speed of the boom cylinder is lower than a target speed.

The hydraulic system may further include a boom angle sensor provided at the construction machinery and serving to measure an angle of the boom, and the control unit may estimate the speed of the boom cylinder based on an angle change amount of the boom angle sensor, and increase the opening area of the first regeneration spool or the second regeneration spool when the estimated speed of the boom cylinder is lower than a target speed.

The hydraulic system may further include a main control valve serving to control supply of the hydraulic oil to the boom cylinder; and an operation device serving to transmit a pilot signal to the main control valve. The target speed may be a moving speed of the boom input through the operation device.

The first boom hydraulic line may connect the main control valve and the head side of the boom cylinder, and the second boom hydraulic line may connect the main control valve and the rod side of the boom cylinder.

The control unit may maintain the opening area of the first regeneration spool larger than the opening area of the second regeneration spool.

The hydraulic system may further include a main pump serving to discharge the hydraulic oil; a main hydraulic line connecting the main pump and the main control valve; an engine serving to drive the main pump; and a regeneration motor connected to the regeneration line and serving to assist the engine.

The control unit may increase an angle of a swash plate of the regeneration motor during the descending operation of the boom.

The hydraulic system may further include an energy storage line connecting the accumulator and the regeneration line; and an accumulator valve provided at the energy storage line. The control unit may close the accumulator valve during the ascending operation of the boom, and open the accumulator valve during the descending operation of the boom.

In addition, the control unit may estimate the speed of the boom cylinder by calculating a flow rate of the hydraulic oil passing through the first regeneration spool based on a pressure difference between opposite ends of the first regeneration spool and based on the opening area of the first regeneration spool, and increase the opening area of the first regeneration spool or the second regeneration spool when the estimated speed of the boom cylinder is lower than a target speed.

Effects of the Invention

A hydraulic system of construction machinery regenerates a potential energy of a boom when the boom descends, and thus the speed of the boom may be controlled to be constant s the operator intends, while improving the fuel efficiency.

DETAILED DESCRIPTION

Figure 1:
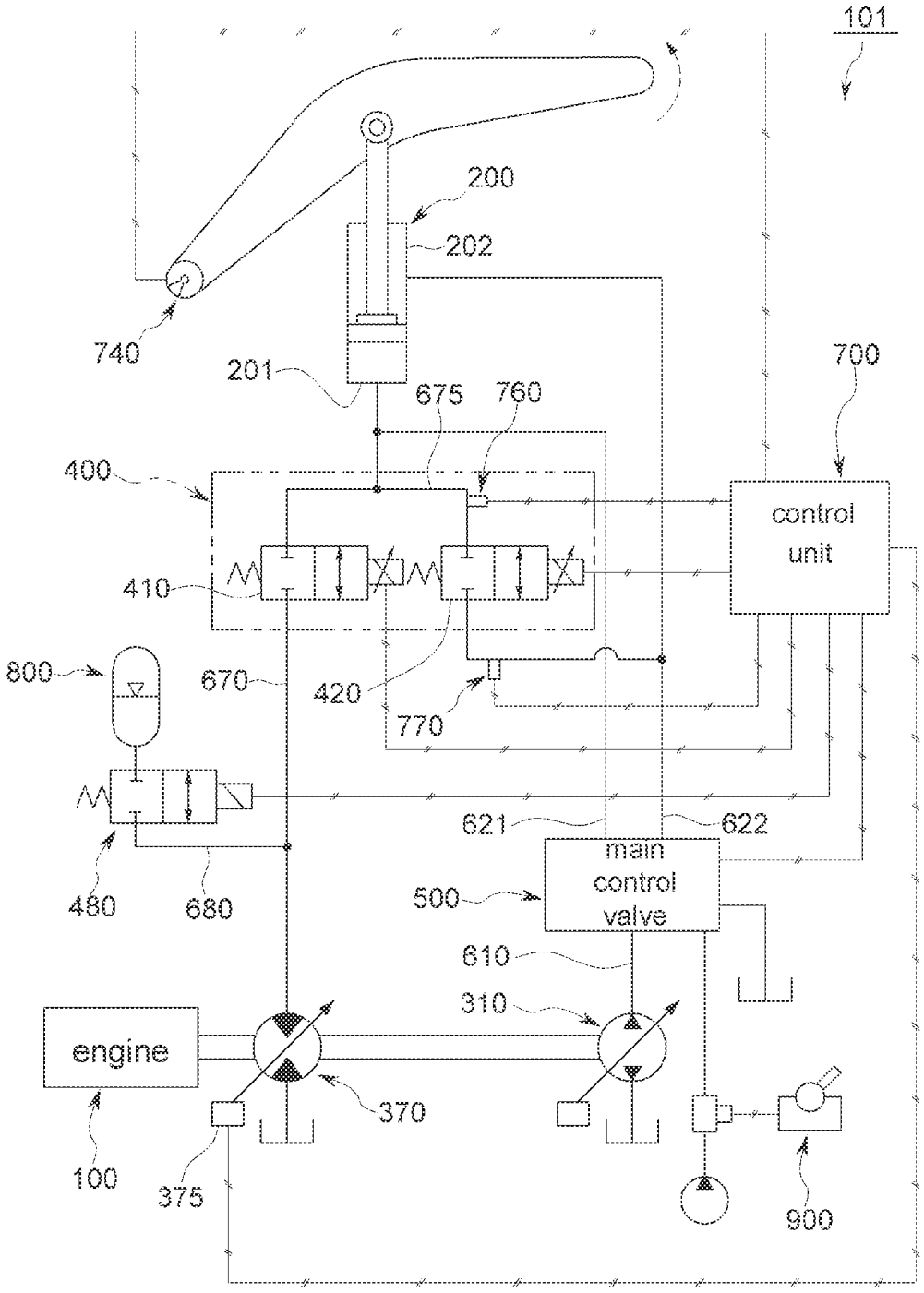
FIG. 1 is a hydraulic circuit diagram illustrating a hydraulic system of construction machinery according to an embodiment of the present invention.

Hereinafter, embodiments of the present invention will be described in detail with reference to the accompanying drawings so that those skilled in the art may easily implement the present invention. The present invention may be implemented in various ways and is not limited to the embodiments described herein.

It is noted that the figures are schematic and not drawn to scale. The relative dimensions and ratios of the parts in the figures are exaggerated or reduced in size for clarity and convenience and any dimensions are merely exemplary and not limiting. The same reference numerals are used to refer to similar features in the same structure, element or part illustrated in more than one figure.

Embodiments of the present invention specifically illustrate desired embodiments of the invention. Accordingly, various modifications of the drawings are expected. Thus, the embodiment is not limited to the specific form of the illustrated region, but includes, for example, modification of the form by manufacture.

Hereinafter, a hydraulic system 101 of construction machinery according to an embodiment of the present invention will be described with reference to FIGS. 1 to 3.

Herein, it is described taking an excavator as an example of a construction machinery. Specifically, the construction machinery includes a boom which moves up and down. In addition, in an embodiment of the present invention, the construction machinery is not limited to excavators, and any construction machinery equipped with work devices such as a boom may be applicable.

In addition, a boom angle sensor 740 for measuring an angle of the boom may be provided at the construction machinery.

As illustrated in FIG. 1, the hydraulic system 101 of construction machinery according to an embodiment of the present invention includes a boom cylinder 200, a first boom hydraulic line 621, a second boom hydraulic line 622, a regeneration line 670, a circulation line 675, an accumulator 800, a boom regeneration valve 400, and a control unit 700.

In addition, the hydraulic system 101 of construction machinery according to an embodiment of the present invention may further include a main control valve (MCV) 500, an operation device 900, a main pump 310, a main hydraulic line 610, an engine 100, a regeneration motor 370, an energy storage line 680, and an accumulator valve 480.

The engine 100 generates power by burning fuel. That is, the engine 100 supplies a rotational power to the main pump 310 to be described below. In addition, embodiments of the present invention are not limited to the above description, and other power devices such as an electric motor may be used instead of the engine 100.

The main pump 310 runs on the power generated by the engine 100 and discharges a hydraulic oil. The hydraulic oil discharged from the main pump 310 may be supplied to various driving devices including the boom cylinder 200, to be described below in addition, the main pump 310 may be a variable displacement pump having a variable flow rate according to an angle of a swash plate.

The MCV 500 controls the supply of hydraulic oil discharged from the main pump 310 to various driving devices including the boom cylinder 200.

In detail, the MCV 500 may include a plurality of control spools. Each of the control spools controls the supply of hydraulic oil to various driving devices including the boom cylinder 200. In addition, the MCV 500 may further include a spool cap (not illustrated) connected to opposite ends of the control spool, receiving a pilot signal of an operation device to be described below, and stroking the control spool. For example, an electronic proportional pressure reducing valve (EPPRV) may be provided at the spool cap, and a pressure applied to the control spool by the pilot signal which is transmitted as a pressure of the hydraulic oil varies according to the degree of opening and closing of the EPPRV. The control spool moves in opposite directions by the pressure applied by the pilot signal.

The operation device 900 includes a joystick, an operation lever, a pedal, and the like provided at a driver's cab so that an operator may operate various work devices and a travel device. The operation device 900 is operated by the operator and transmits the pilot signal to the MCV 500 as the operator intends. In addition, the MCV 500 may adjust the hydraulic oil supplied to the various driving devices according to the pilot signal received through the operation device 900.

The main hydraulic line 610 connects the main pump 310 and the MCV 500. That is, the main hydraulic line 610 transmits the hydraulic oil discharged from the main pump 310, so that the MCV 500 may distribute and adjust the hydraulic oil.

The regeneration motor 370 is connected to the regeneration line 670, to be described below, and is operated on the pressure of the hydraulic oil supplied through the regeneration line 670. The regeneration motor 370 may serve the engine 100 to drive the main pump 310. That is, the fuel efficiency of the engine 100 may be improved by the degree of the main pump 310 being driven by the regeneration motor 370.

In addition, the regeneration motor 370 may also be a variable displacement type, and the angle of the swash plate may be adjusted by a regulator 375. In addition, the regulator 375 for adjusting the angle of the swash plate of the regeneration motor 370 may be controlled by the control unit 700 to be described below.

For example, the engine 100, the main pump 310, and the regeneration motor 370 may be directly connected to each other.

The boom cylinder 200 drives the boom of the excavator in a vertical direction. The boom cylinder 200 is divided into a head side 201 and a rod side 202.

The first boom hydraulic line 621 connects the MCV 500 and the head side 201 of the boom cylinder 200, and the second boom hydraulic line 622 connects the MCV 500 and the rod side 202 of the boom cylinder 200. Specifically, the first boom hydraulic line 621 is connected to the head side 201 of the boom cylinder 200 to supply the hydraulic oil to the boom cylinder 200 during an ascending operation of the boom. The second boom hydraulic line 622 is connected to the rod side 202 of the boom cylinder 200 to supply the hydraulic oil to the boom cylinder 200 during a descending operation of the boom.

The regeneration line 670 branches from the first boom hydraulic line 621 and serves the hydraulic oil discharged from the head side 201 of the boom cylinder 200 to flow during the descending operation of the boom. In addition, the regeneration line 670 is connected to the regeneration motor 370, and the hydraulic oil having flown along the regeneration line 670 drives the regeneration motor 370.

The circulation line 675 branches from the regeneration line 670 and is connected to the second boom hydraulic line 622. Accordingly, during the descending operation of the boom, part of the hydraulic oil discharged from the head side 201 of the boom cylinder 200 flows along the circulation line 675 and then flows into the rod side 202 of the boom cylinder 200 through the second boom hydraulic line 622. As such, since the hydraulic oil discharged from the head side 201 of the boom cylinder 200 flows into the rod side 202 of the boom cylinder 200 while the boom descends, a descending speed of the boom may be increased, and energy utilization efficiency may be improved.

The accumulator 800 is connected to the regeneration line 670 and accumulates the hydraulic oil discharged from the boom cylinder 200. The accumulator 800 is a device for storing the hydraulic oil of high pressure in a hydraulic system.

The energy storage line 680 connects the accumulator 800 and the regeneration line 670, and the accumulator valve 480 is provided at the energy storage line 680 to open and close the energy storage line 680. The accumulator valve 480 is controlled by the control unit 700, to be described below, and is open when the boom descends and when the regeneration motor 370 is driven by using the hydraulic oil of high pressure stored in the accumulator 800.

The boom regeneration valve 400 includes a first regeneration spool 410 provided at the regeneration line 670 and a second regeneration spool 420 provided at the circulation line 675. In addition, the first regeneration spool 410 and the second regeneration spool 420 may open and close the regeneration line 670 and the circulation line 675, respectively, and may adjust flow rates thereof, respectively.

The control unit 700 may control various components of the construction machinery, such as the engine 100 and the MCV 500. The control unit 700 may include one or more of an engine control unit (ECU) and a vehicle control unit (VCU).

In addition, in an embodiment of the present invention, the control unit 700 closes the boom regeneration valve 400 during the ascending operation of the boom and adjusts opening areas of the first regeneration spool 410 and the second regeneration spool 420 during the descending operation of the boom.

Specifically, the control unit 700 estimates the speed of the boom cylinder 200 by calculating the flow rate of the hydraulic oil passing through the second regeneration spool 420 based on a pressure difference between opposite ends of the second regeneration spool 420 and the opening area of the second regeneration spool 420. The flow rate of the hydraulic oil passing through the second regeneration spool 420 is proportional to the descending speed of the boom. When the estimated speed of the boom cylinder 200 is lower than a target speed, the opening area of the second regeneration spool 420 is increased, and when the estimated speed of the boom cylinder 200 is higher than the tar speed, the opening area of the second regeneration spool 420 is reduced. In such an embodiment, the target speed is a moving speed of the boom which is input through the operation device 900 as the operator intends.

When the hydraulic oil begins to accumulate in the accumulator 800, a pressure of the accumulator 800 increases, and a pressure of the regeneration line 670 also increases in proportion to the pressure increase of the accumulator 800. When a pressure difference between opposite ends of the first regeneration spool 410 thus decreases, the flow rate of the hydraulic oil discharged through the regeneration line 670 is decreased, and accordingly, the descending speed of the boom starts to decrease. The decrease in the descending speed of the boom decreases the flow rate of the hydraulic oil passing through the second regeneration spool 420, and accordingly, the pressure difference between the opposite ends of the second regeneration spool 420 is also decreased.

The control unit 700 may calculate the speed of the boom cylinder 200, that is, the descending speed of the boom, based on the pressure difference between the opposite ends of the second regeneration spool 420 and the opening area of the second regeneration spool 420 at the current position. Since the pressure difference between the opposite ends of the second regeneration spool 420 is decreased, it may be identified that the flow rate passing through the second regeneration spool 420 is decreased.

The control unit 700 compares the decrease in flow rate of the hydraulic oil passing through the second regeneration spool 420 with a target flow rate of the second regeneration spool 420 according to the pilot signal of the operation device 900. In a case where the flow rate currently passing through the second regeneration spool 420 is less than the target flow rate, the control unit 700 transmits an increased control signal to the second regeneration spool 420 so that the pass flow rate may follow the target flow rate.

As the flow rate of the hydraulic oil passing through the second regeneration spool 420 increases, the speed of the boom cylinder 200 increases. On the other hand, as the flow rate of the hydraulic oil passing through the second regeneration spool 420 decreases, the speed of the boom cylinder 200 also decreases. Accordingly, the flow rate of the hydraulic oil passing through the second regeneration spool 420 corresponds to the estimated speed of the boom cylinder 200, and the target flow rate of the second regeneration spool 420 according to the pilot signal of the operation device 900 corresponds to the target speed of the boom cylinder 200.

As such, in a case where it is identified that the estimated speed of the boom cylinder 200, calculated based on a control reference value transmitted to the second regeneration spool 420 according to the operation of the operation device 900 by the operator and on the pressure difference between the opposite ends of the second regeneration spool 420, is lower than the target speed, the control unit 700 increases a second regeneration spool control signal value to compensate for this. Accordingly, the opening area of the second regeneration spool 420 is increased, and the pressure applied to the rod side 202 of the boom cylinder 200 is increased. Thus, the pressure of the hydraulic oil discharged to the head side 201 of the boom cylinder 200 further increases to compensate for the decrease in the descending speed of the boom that may occur due to an increasing pressure of the hydraulic oil which increases as the hydraulic oil accumulates in the accumulator 800. Finally, the descending speed of the boom may be maintained constant as the operator intends.

In addition, a first pressure sensor 760 and a second pressure sensor 770 are provided at opposite ends of the second regeneration spool 420, respectively, or on the circulation line 675 connected to the opposite ends of the second regeneration spool 420, respectively. The control unit 700 may determine a pressure difference between the opposite ends of the second regeneration spool 420 based on the information provided by the first pressure sensor 760 and the second pressure sensor 770.

In addition, in an embodiment of the present invention, the control unit 700 maintains the opening area of the first regeneration spool 410 to be larger than the opening area of the second regeneration spool 420. More hydraulic oil may be accumulated in the accumulator 800 through the regeneration line 670, when the opening area of the first regeneration spool 410 is larger than the opening area of the second regeneration spool 420. That is, the hydraulic oil stored in the accumulator 800 may have a higher pressure. Accordingly, in an embodiment of the present invention, a first regeneration spool control signal value is also increased in proportion to the second regeneration spool control signal value being increased.

In addition, in an embodiment of the present invention, the control unit 700 increases the angle of the swash plate of the regeneration motor 370, when the regeneration motor 370 is driven using the energy stored in the accumulator 800 or during the descending operation of the boom. For other operations, the angle of the swash plate of the regeneration motor 370 is maintained at a minimum angle of the swash plate.

By such a configuration, the hydraulic system 101 of construction machinery according to an embodiment of the present invention may regenerate the potential energy of the boom when the boom descends, thereby capable of controlling the speed of the boom to be constant as the operator intends, while improving the fuel efficiency.

Hereinafter, the operating principle of the hydraulic system 101 of construction machinery according to an embodiment of the present invention will be described in detail with reference to FIGS. 1 to 4.

Figure 3:
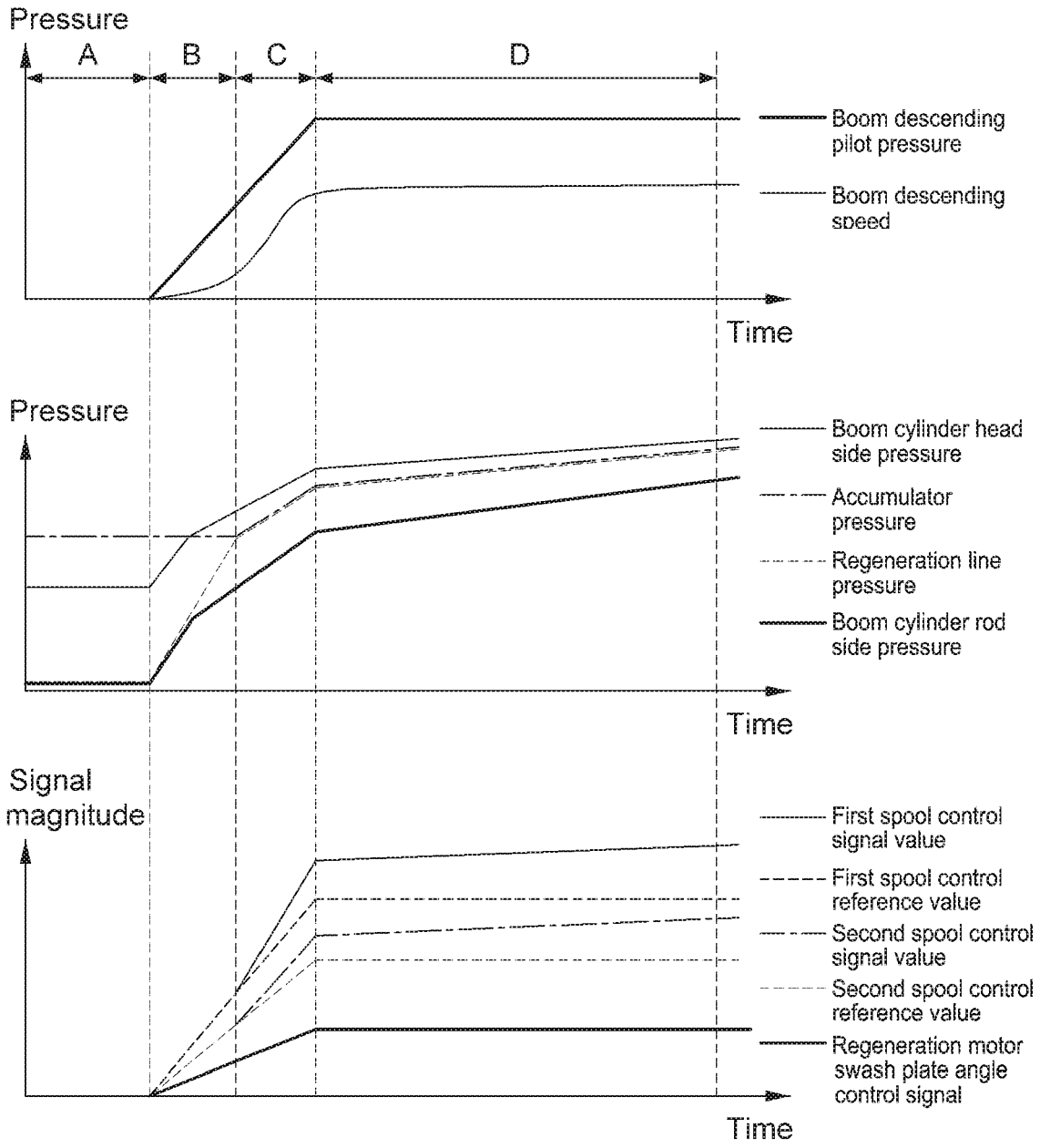
FIG. 3 is a graph illustrating a change in pressure of a hydraulic oil and a change in magnitude of a control signal according to operation of the hydraulic system of construction machinery of FIG. 1.

As illustrated in FIGS. 1 and 3, when the boom is ascending or in a neutral state, the first regeneration spool 410, the second regeneration spool 420, and the accumulator valve 480 of the boom regeneration valve 400 are in a closed state. This neutral state corresponds to section A in FIG. 3.

For example, in the neutral state, it may be assumed that a pressure at the head side 201 of the boom cylinder 200 is 100 bar, a pressure at the rod side 202 of the boom cylinder 200 is 5 bar, and a pressure at the accumulator 800 before charging is 130 bar.

Figure 2:
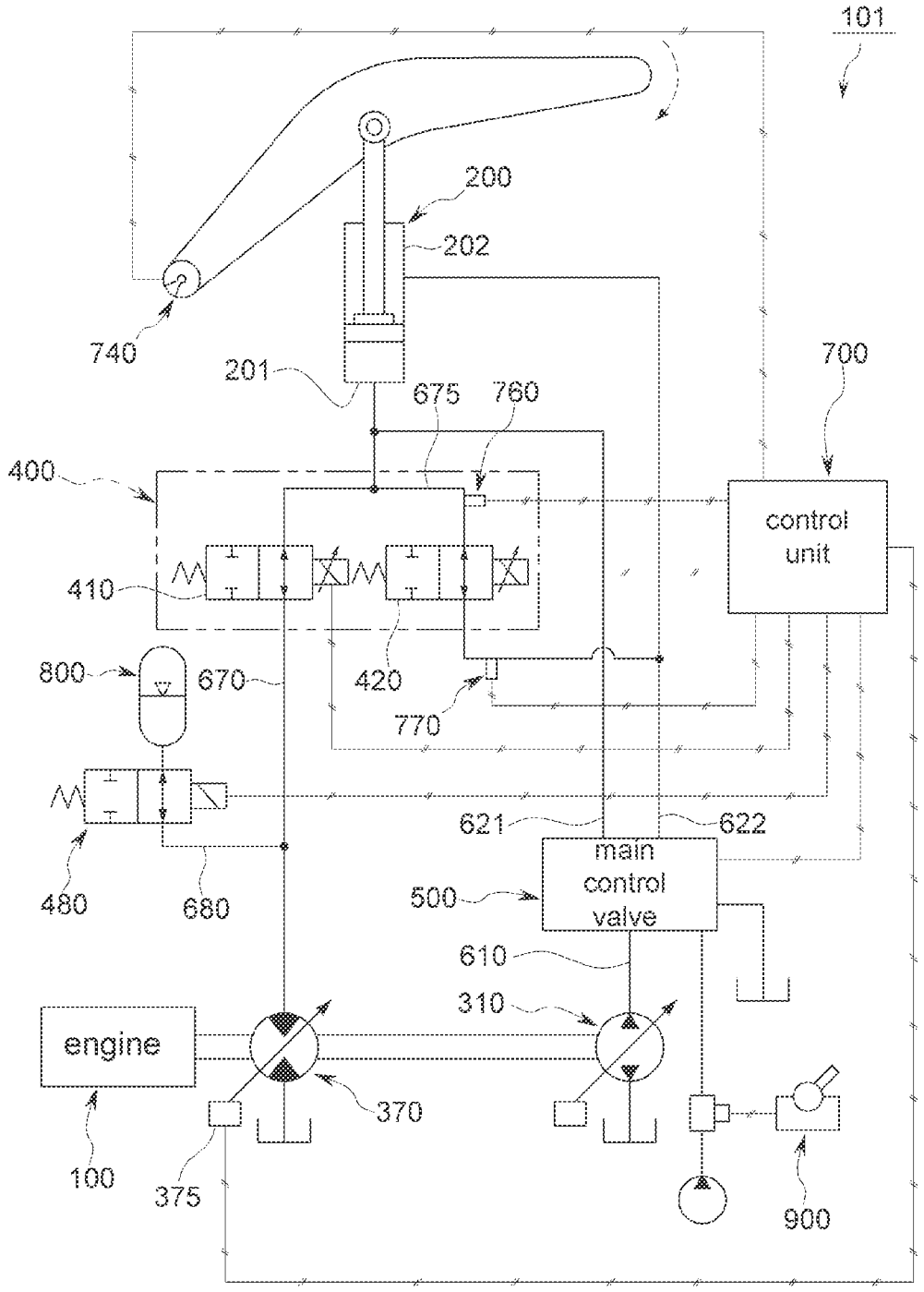
FIG. 2 is a hydraulic circuit diagram illustrating an operation state of the hydraulic system of construction machinery of FIG. 1.
Figure 4:
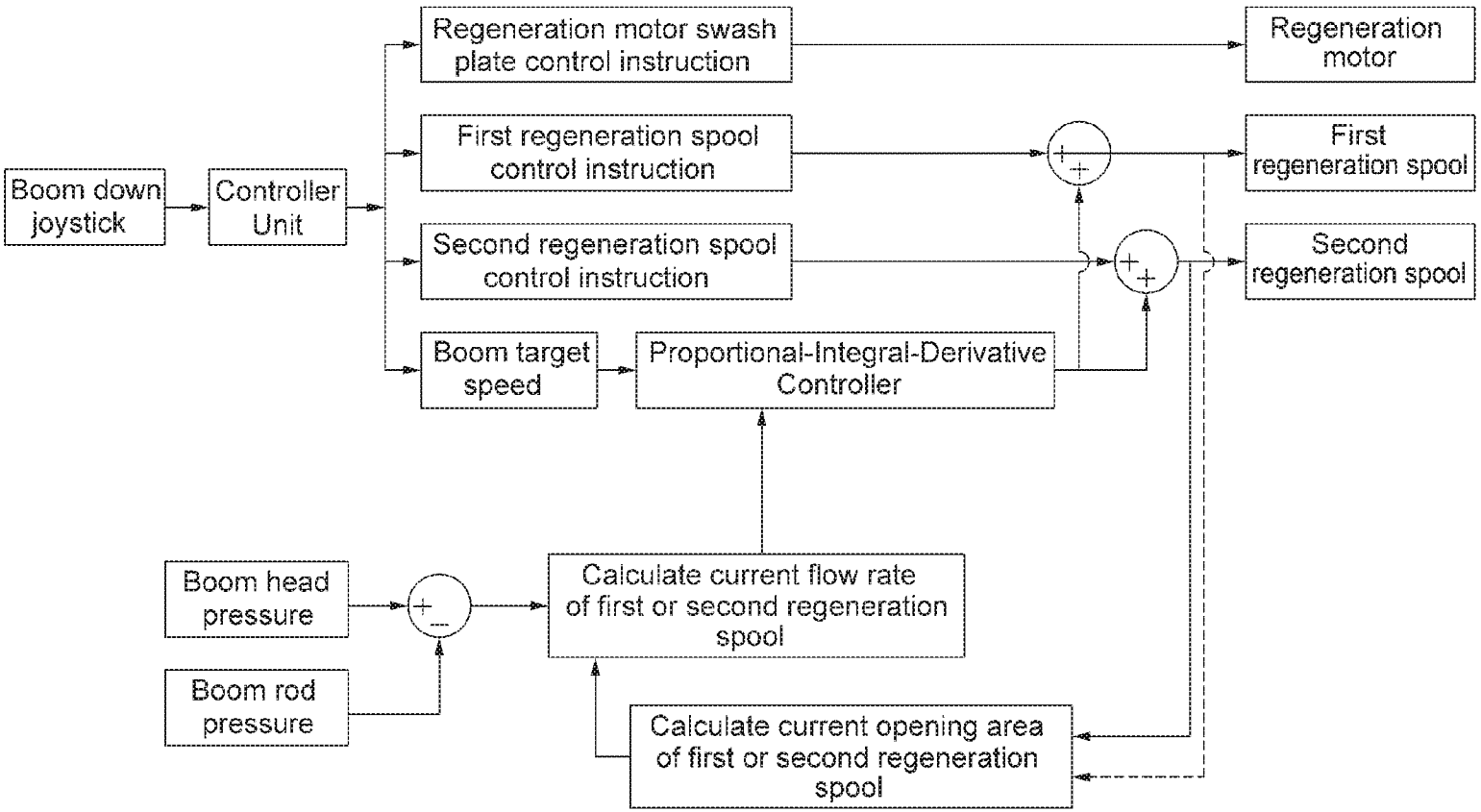
FIG. 4 is a control flowchart illustrating a control flow of the hydraulic system of construction machinery of FIG. 1.

As illustrated in FIGS. 2 and 4, when the pilot signal for lowering the boom is transmitted to the MCV 500 through the operation device 900, the control unit 700 opens the accumulator valve 480, and controls the first regeneration spool 410 and the second regeneration spool 420 of the boom regeneration valve 400 according to the control reference value corresponding to the pilot signal of the operation device 900, thereby adjusting their opening areas. In addition, the control unit 700 increases the angle of the swash plate of the regeneration motor 370 from the minimum angle of the swash plate. In such an embodiment, the pilot signal for lowering the boom may be generated through a boom down joystick.

Then, the hydraulic oil discharged from the head side 201 of the boom cylinder 200 is transmitted to the rod side 202 of the boom cylinder 200 through the second regeneration spool 420. Accordingly, the pressure of the rod side 202 of the boom cylinder 200 increases, and the increased pressure of the rod side 202 increases the pressure of the head side 201 once again. Thus, both the pressure of the head side 201 and the pressure of the rod side 202 of the boom cylinder 200 increase.

This corresponds to section B in FIG. 3. However, in section B, since the opening area of the second regeneration spool 420 is small, there is a certain level of pressure difference between the head side 201 and the rod side 202 of the boom cylinder 200. The boom starts to descend as the hydraulic oil discharged from the head side 201 of the boom cylinder 200 is supplied to the regeneration motor 370 along the regeneration line 670 through the first regeneration spool 410.

However, since the pressure of the regeneration line 670 is lower than the pressure of the accumulator 800 in section B, energy charging of the accumulator 800 does not occur.

When the pressure of the regeneration line 670 increases and enters section C of FIG. 3, the pressure of the regeneration line 670 becomes higher than the pressure of the accumulator 800 before charging. Then, part of the hydraulic oil having passed through the first regeneration spool 410 starts to be charged in the accumulator 800.

When the hydraulic oil accumulates in the accumulator 800, the pressure of the accumulator 800 increases, and when the pressure of the accumulator 800 increases, the pressure of the regeneration line 670 connected thereto also increases.

Accordingly, when the pressure difference between the opposite ends of the first regeneration spool 410 decreases, the flow rate of the hydraulic oil discharged through the regeneration line 670 is decreased, and the descending speed of the boom starts to decrease. The decrease in the descending speed of the boom decreases the flow rate of the hydraulic oil passing through the second regeneration spool 420, and accordingly, the pressure difference between the opposite ends of the second regeneration spool 420 also decreases.

The control unit 700 calculates the flow rate of the hydraulic oil passing through second regeneration spool 420 based on the information on the pressure difference between the opposite ends of the second regeneration spool 420 and the opening area of the second regeneration spool 420 at the current position, and then estimates a current speed of the boom cylinder 200 based on the flow rate of the hydraulic oil passing through the second regeneration spool 420. In such an embodiment, the speed of the boom cylinder 200 has the same meaning as the descending speed of the boom. That is, it may be appreciated that when the pressure difference between the opposite ends of the second regeneration spool 420 is decreased, the flow rate of the hydraulic oil passing through the second regeneration spool 420 is decreased, and thus the descending speed of the boom is decreased.

In addition, embodiments of the present invention are not limited to the above. That is, the control unit 700 may calculate the flow rate of the hydraulic oil passing through the first regeneration spool 410 based on the information on the pressure difference between the opposite ends of the first regeneration spool 410 and the opening area of the first regeneration spool 410 at the current position, and may estimate the current speed of the boom cylinder 200 based on the flow rate of the hydraulic oil passing through the first regeneration spool 410.

In addition, the control unit 700 may estimate the current speed of the boom cylinder 200 by using the boom angle sensor 740 provided at the construction machinery to measure the angle of the boom. That is, the control unit 700 may estimate the speed of the boom cylinder 200 according to an angle change amount of the boom angle sensor 740.

In addition, when it is identified that the estimated speed of the boom cylinder 200 is lower than the target speed of the boom cylinder 200 according to the operation of the operation device 900, the control unit 700 increases the second regeneration spool control signal value transmitted to the second regeneration spool 420 to increase the opening area of the second regeneration spool 420 so that the estimated speed of the boom cylinder 200 may follow the target speed. Such feedback control may be implemented using a proportional-integral-derivative control unit.

When the opening area of the second regeneration spool 420 is increased, the pressure applied to the rod side 202 of the boom cylinder 200 increases. Accordingly, the pressure of the hydraulic oil discharged to the head side 201 of the boom cylinder 200 further increases to compensate for the decrease in the descending speed of the boom that may occur due to an increasing pressure of the hydraulic oil which increases as the hydraulic oil accumulates in the accumulator 800.

In addition, since the hydraulic oil may be stored in the accumulator 800 to the maximum when the opening area of the first regeneration spool 410 is kept larger than the opening area of the second regeneration spool 420, the opening area of the first regeneration spool 410 is also increased by increasing the first regeneration spool control signal value transmitted to the first regeneration spool 410 in proportion to the increase of the second regeneration spool control signal value transmitted to the second regeneration spool 420.

When entering section D of FIG. 3, the pilot signal transmitted through the operation device 900 is kept constant, and similar to section C, part of the hydraulic oil discharged from the head side 201 of the boom cylinder 200 flows into the rod side 202 through the second regeneration spool 420, and the rest is supplied to the regeneration motor 370 and the accumulator 800 through the first regeneration spool 410.

In addition, as the hydraulic oil accumulates in the accumulator 800, the pressure of the accumulator 800 continuously increases, and in proportion to the increase, the pressure of the regeneration line 670 also increases.

Accordingly, the pressure difference between the opposite ends of the first regeneration spool 410 also decreases continuously, and thus similar to section C, the control unit 700 increases the first regeneration spool control signal value and the second regeneration spool control signal value respectively transmitted to the first regeneration spool 410 and the second regeneration spool 420 in order to compensate for the decrease in the descending speed of the boom.

Accordingly, the descending speed of the boom may be maintained constant as the operator intends to operate.

Although embodiments of the present invention have been described above with reference to the accompanying drawings, those skilled in the art may understand that the present invention may be implemented in other specific forms without changing the technical spirit or essential features.

The foregoing description is merely illustrative of the present invention, and various modifications may be made by those skilled in the art without departing from the spirit of the present invention. Accordingly, the embodiments disclosed herein are not intended to limit the present invention. The scope of the present invention should be construed according to the following claims, and all changes or modifications derived from the meaning and scope of the claims and their equivalents should be construed as being included in the scope of the present invention.

INDUSTRIAL APPLICABILITY

The hydraulic system of construction machinery according to one or more embodiments of the present invention may be used to regenerate a potential energy of a boom during a descending operation of the boom so as to control a speed of the boom to be constant as the operator intends, while improving the fuel efficiency.

The invention claimed is:

1. A hydraulic system of construction machinery, comprising:

a boom cylinder divided into a head side and a rod side;

a first boom hydraulic line connected to the head side of the boom cylinder and configured to supply a hydraulic oil to the boom cylinder during an ascending operation of a boom;

a second boom hydraulic line connected to the rod side of the boom cylinder and configured to supply the hydraulic oil to the boom cylinder during a descending operation of the boom;

a regeneration line branching from the first boom hydraulic line and serving so that the hydraulic oil discharged from the head side of the boom cylinder flows during the descending operation of the boom;

a circulation line branching from the regeneration line and connected to the second boom hydraulic line;

an accumulator connected to the regeneration line and configured to accumulate the hydraulic oil discharged from the boom cylinder;

a boom regeneration valve comprising a first regeneration spool provided at the regeneration line and a second regeneration spool provided at the circulation line;

a control unit configured to close the boom regeneration valve during the ascending operation of the boom and to adjust opening areas of the first regeneration spool and the second regeneration spool by estimating a speed of the boom cylinder during the descending operation of the boom, an energy storage line connecting the accumulator and the regeneration line; and an accumulator valve provided at the energy storage line, wherein the control unit maintains the opening area of the first regeneration spool larger than the opening area of the second regeneration spool.

2. The hydraulic system of construction machinery of claim 1, further comprising a pressure sensor provided at opposite ends of the second regeneration spool, wherein the control unit:

estimates the speed of the boom cylinder by calculating a flow rate of the hydraulic oil passing through the second regeneration spool based on a pressure difference between opposite ends of the second regeneration spool measured by the pressure sensor and based on the opening area of the second regeneration spool, and increases the opening area of the first regeneration spool or the second regeneration spool when the estimated speed of the boom cylinder is lower than a target speed.

3. The hydraulic system of construction machinery of claim 2, further comprising:

a main control valve configured to control supply of the hydraulic oil to the boom cylinder; and an operation device configured to transmit a pilot signal to the main control valve, wherein the target speed is a moving speed of the boom input through the operation device.

4. The hydraulic system of construction machinery of claim 3, wherein the first boom hydraulic line connects the main control valve and the head side of the boom cylinder, and the second boom hydraulic line connects the main control valve and the rod side of the boom cylinder.

5. The hydraulic system of construction machinery of claim 1, further comprising a boom angle sensor provided at the construction machinery and configured to measure an angle of the boom, wherein the control unit:

estimates the speed of the boom cylinder based on an angle change amount of the boom angle sensor, and increases the opening area of the first regeneration spool or the second regeneration spool when the estimated speed of the boom cylinder is lower than a target speed.

6. The hydraulic system of construction machinery of claim 5, further comprising:

a main control valve configured to control supply of the hydraulic oil to the boom cylinder; and an operation device configured to transmit a pilot signal to the main control valve, wherein the target speed is a moving speed of the boom input through the operation device.

7. The hydraulic system of construction machinery of claim 1, further comprising:

a main pump configured to discharge the hydraulic oil;

a main hydraulic line connecting the main pump and a main control valve;

an engine configured to drive the main pump; and a regeneration motor connected to the regeneration line and configured to assist the engine.

8. The hydraulic system of construction machinery of claim 7, wherein the control unit increases an angle of a swash plate of the regeneration motor during the descending operation of the boom.

9. The hydraulic system of construction machinery of claim 1, wherein the control unit:

estimates the speed of the boom cylinder by calculating a flow rate of the hydraulic oil passing through the first regeneration spool based on a pressure difference between opposite ends of the first regeneration spool and based on the opening area of the first regeneration spool, and increases the opening area of the first regeneration spool or the second regeneration spool when the estimated speed of the boom cylinder is lower than a target speed.

10. A hydraulic system of construction machinery, comprising:

a boom cylinder divided into a head side and a rod side;

a first boom hydraulic line connected to the head side of the boom cylinder and configured to supply a hydraulic oil to the boom cylinder during an ascending operation of a boom;

a second boom hydraulic line connected to the rod side of the boom cylinder and configured to supply the hydraulic oil to the boom cylinder during a descending operation of the boom;

a regeneration line branching from the first boom hydraulic line and serving so that the hydraulic oil discharged from the head side of the boom cylinder flows during the descending operation of the boom;

a circulation line branching from the regeneration line and connected to the second boom hydraulic line;

an accumulator connected to the regeneration line and configured to accumulate the hydraulic oil discharged from the boom cylinder;

a boom regeneration valve comprising a first regeneration spool provided at the regeneration line and a second regeneration spool provided at the circulation line;

a control unit configured to close the boom regeneration valve during the ascending operation of the boom and to adjust opening areas of the first regeneration spool and the second regeneration spool by estimating a speed of the boom cylinder during the descending operation of the boom, an energy storage line connecting the accumulator and the regeneration line; and an accumulator valve provided at the energy storage line, wherein the control unit closes the accumulator valve during the ascending operation of the boom and opens the accumulator valve during the descending operation of the boom.

* * * * *